US009857769B2

(12) United States Patent
Ono et al.

(10) Patent No.: US 9,857,769 B2
(45) Date of Patent: Jan. 2, 2018

(54) IMAGE FORMING APPARATUS AND METHOD AND INFORMATION PROCESSING SYSTEM

(71) Applicant: FUJI XEROX CO., LTD., Tokyo (JP)

(72) Inventors: Yoshiyuki Ono, Kanagawa (JP); Haruo Harada, Kanagawa (JP); Akira Tateishi, Kanagawa (JP); Hiromitsu Ohashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/226,394

(22) Filed: Aug. 2, 2016

(65) Prior Publication Data

US 2017/0255161 A1 Sep. 7, 2017

(30) Foreign Application Priority Data

Mar. 4, 2016 (JP) ..... 2016-042799

(51) Int. Cl.
*G03G 21/20* (2006.01)
*B41J 2/01* (2006.01)

(52) U.S. Cl.
CPC ..... *G03G 21/206* (2013.01); *B41J 2/01* (2013.01)

(58) Field of Classification Search
CPC ..... G03G 21/206; B41J 2/01
See application file for complete search history.

(56) References Cited

U.S. PATENT DOCUMENTS 5,481,339 A * 1/1996 De Cock ..... G03G 21/203 399/93
2015/0028114 A1* 1/2015 Rosen ..... F24F 11/0034 236/51

FOREIGN PATENT DOCUMENTS

| | | | |
|---|---|---|---|
| JP | 06-043252 | | 2/1994 |
| JP | 2015-066329 | A | 4/2015 |
| JP | 2015-201845 | A | 11/2015 |
| WO | 2007/052886 | A1 | 5/2007 |
| WO | 2008/007433 | A2 | 7/2016 |

* cited by examiner

*Primary Examiner* — Rodney Bonnette
(74) *Attorney, Agent, or Firm* — Oliff PLC

(57) ABSTRACT

An image forming apparatus includes an image forming unit, first and second obtaining units, an output unit, and a sender. The image forming unit forms an image on a recording medium. The first obtaining unit obtains, from each of plural measuring devices provided in different locations outside an air-conditioning control device, environment information indicating an environment around a corresponding measuring device. The second obtaining unit obtains position information indicating a position of a user. The output unit outputs air-conditioning control information based on the obtained environment information and the obtained position information for controlling a subject air-conditioning control device. The sender sends the output air-conditioning control information to a destination device.

11 Claims, 16 Drawing Sheets

FIG. 8

| FIELD NAME | MANDATORY/OPTIONAL | TYPE | SPECIFIC EXAMPLE |
|---|---|---|---|
| timestamp | Optional | string | 2016-01-14T04:47:20. |
| observation | Mandatory | long | - |
| receiverID | Mandatory | string | 55 |
| sensorID | Mandatory | string | 144 |

FIG. 9

| FIELD NAME | SPECIFIC EXAMPLE |
|---|---|
| dataclass | AirTemperature |
| value | 20 |
| location | 35,135 |
| datum | WGS84 |
| elevation | 5 |
| at | 2016-01-10T10:20:30. |
| unit | degree Celsius |
| accuracy | 50 |

IMAGE FORMING APPARATUS AND METHOD AND INFORMATION PROCESSING SYSTEM

CROSS-REFERENCE TO RELATED APPLICATIONS

This application is based on and claims priority under 35 USC 119 from Japanese Patent Application No. 2016-042799 filed Mar. 4, 2016.

BACKGROUND

Technical Field

The present invention relates to an image forming apparatus and method and an information processing system.

SUMMARY

According to an aspect of the invention, there is provided an image forming apparatus including an image forming unit, first and second obtaining units, an output unit, and a sender. The image forming unit forms an image on a recording medium. The first obtaining unit obtains, from each of plural measuring devices provided in different locations outside an air-conditioning control device, environment information indicating an environment around a corresponding measuring device. The second obtaining unit obtains position information indicating a position of a user. The output unit outputs air-conditioning control information based on the obtained environment information and the obtained position information for controlling a subject air-conditioning control device. The sender sends the output air-conditioning control information to a destination device.

BRIEF DESCRIPTION OF THE DRAWINGS

An exemplary embodiment of the present invention will be described in detail based on the following figures, wherein:

FIG. 8 illustrates a table indicating an example of the data format of position sensor data;

FIG. 9 illustrates a table indicating an example of the data format of environment sensor data;

DETAILED DESCRIPTION

An exemplary embodiment of the invention will be described below in detail with reference to the accompanying drawings.

(Air-Conditioning Control System)

Figure 1:
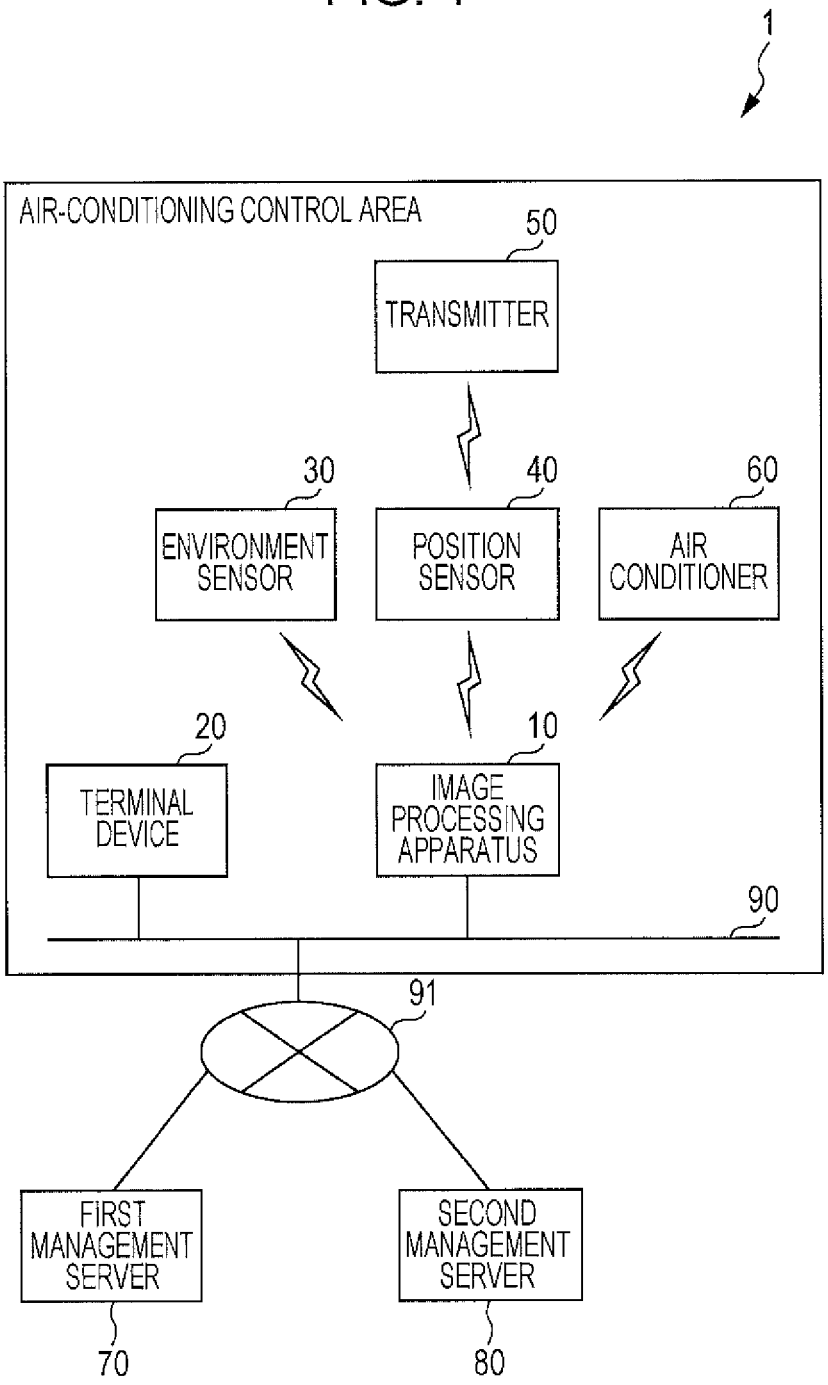
FIG. 1 is a block diagram illustrating an example of the overall configuration of an air-conditioning control system according to an exemplary embodiment of the invention.

FIG. 1 illustrates an example of the overall configuration of an air-conditioning control system 1 according to an exemplary embodiment of the invention.

As shown in FIG. 1, in the air-conditioning control system 1, an image processing apparatus 10 and a terminal device 20 are connected to a network 90 and are then connected to a network 91 via a communication device (not shown), such as a router. A first management server 70 and a second management server 80 are also connected to the network 91. An environment sensor 30, a position sensor 40, and an air conditioner 60 are connected to the image processing apparatus 10 via a wired field network or a wireless communication network so that they can communicate with the image processing apparatus 10. Examples of the wired field network are networks based on Ethernet (registered trademark), such as a regular LAN (Local Area Network), EtherCAT (Ethernet for Control Automation Technology (registered trademark)), and CC-Link IE (registered trademark), and serial communication networks, such as GPIB (General Purpose Interface Bus) (IEEE488) and RS485. In the case of the use of a network based on Ethernet, the network 90 may be used for connecting the environment sensor 30, the position sensor 40, and the air conditioner 60 with the image processing apparatus 10. Alternatively, an independent network may be used. As the wireless communication network, existing media may be used, such as Wi-Fi (registered trademark) (Wireless Fidelity), Bluetooth (registered trademark), ZigBee (registered trademark), and UWB (Ultra Wideband). In FIG. 1, the environment sensor 30, the position sensor 40, and the air conditioner 60 are connected to the image processing apparatus 10 via a wireless communication network. In this exemplary embodiment, the environment sensor 30 is used as an example of a measuring device. The image processing apparatus 10 is used as an example of an image forming apparatus.

The image processing apparatus 10 is a so-called multifunction device having multiple functions, such as a print function, a copy function, a scan function, and a fax function. The image processing apparatus 10 performs image processing on image data sent from the terminal device 20 and forms an image on a recording medium, such as paper, on the basis of the processed image data. The image processing apparatus 10 also sends and receives data to and from the environment sensor 30, the position sensor 40, and the air conditioner 60 by wireless communication. The image processing apparatus 10 also sends and receives data to and from the first and second management servers 70 and 80 via the networks 90 and 91. Accordingly, the image processing apparatus 10 serves as an apparatus that is operated by a user in the office to perform printing, for example, and also serves as an apparatus that sends and receives data to and from devices disposed inside and outside the office.

The specific functions of the image processing apparatus 10 will be discussed. By wireless communication, the image processing apparatus 10 obtains sensor data from the environment sensor 30 and also obtains sensor data from the position sensor 40. Then, the image processing apparatus 10 generates control information for controlling the air conditioner 60 (hereinafter referred to as "air-conditioning control information"), based on the sensor data obtained from the environment sensor 30 (hereinafter referred to as "environment sensor data") and the sensor data obtained from the position sensor 40 (hereinafter referred to as "position sensor data"). The image processing apparatus 10 sends the generated air-conditioning control information to a certain destination (for example, the first and second management servers 70 and 80 in FIG. 1). The image processing apparatus 10 may send the air-conditioning control information to the air conditioner 60. The image processing apparatus 10 may send the air-conditioning control information to another image processing apparatus, which is not shown.

Before sending the air-conditioning control information, the image processing apparatus 10 performs conversion processing for converting the formats (protocols) of the environment sensor data and the position sensor data obtained from the environment sensor 30 and the position sensor 40, respectively, into formats supported by a destination (for example, the first and second management servers 70 and 80 in FIG. 1) and performs data processing based on the destination. In this exemplary embodiment, the environment sensor data and the position sensor data are an example of measurement data.

Details of processing performed by the image processing apparatus 10 will be discussed later.

The terminal device 20 is a device operated by a user to print data indicating an image or a document, for example. The terminal device 20 may be a personal computer (PC). The terminal device 20 generates image data in response to an instruction received from a user, and sends the generated image data to the image processing apparatus 10.

Although only one terminal device 20 is shown in FIG. 1, plural terminal devices 20 may be connected to the network 90.

The environment sensor 30 is a sensor disposed outside the air conditioner 60. The environment sensor 30 senses the environments around the environment sensor 30 regularly (for example, in every few minutes) and generates environment sensor data indicating the environments around the environment sensor 30. The environment sensor data is generated, for example, in the REST (Representational State Transfer) format (protocol) used in web services. Examples of information concerning the environments (hereinafter referred to as "environment information") represented by the environment sensor data are the temperature, humidity, atmospheric pressure, illuminance, acceleration (for example, the acceleration in three directions such as the perpendicular direction and the horizontal direction in a plane parallel with the ground and the vertical direction with respect to a plane parallel with the ground), ultraviolet (UV) density (UV dose), carbon dioxide concentration (carbon dioxide amount), wind speed, and wind direction around the environment sensor 30.

Only one environment sensor 30 is shown in FIG. 1. In actuality, however, plural environment sensors 30 are installed in different locations.

Figure 2A:
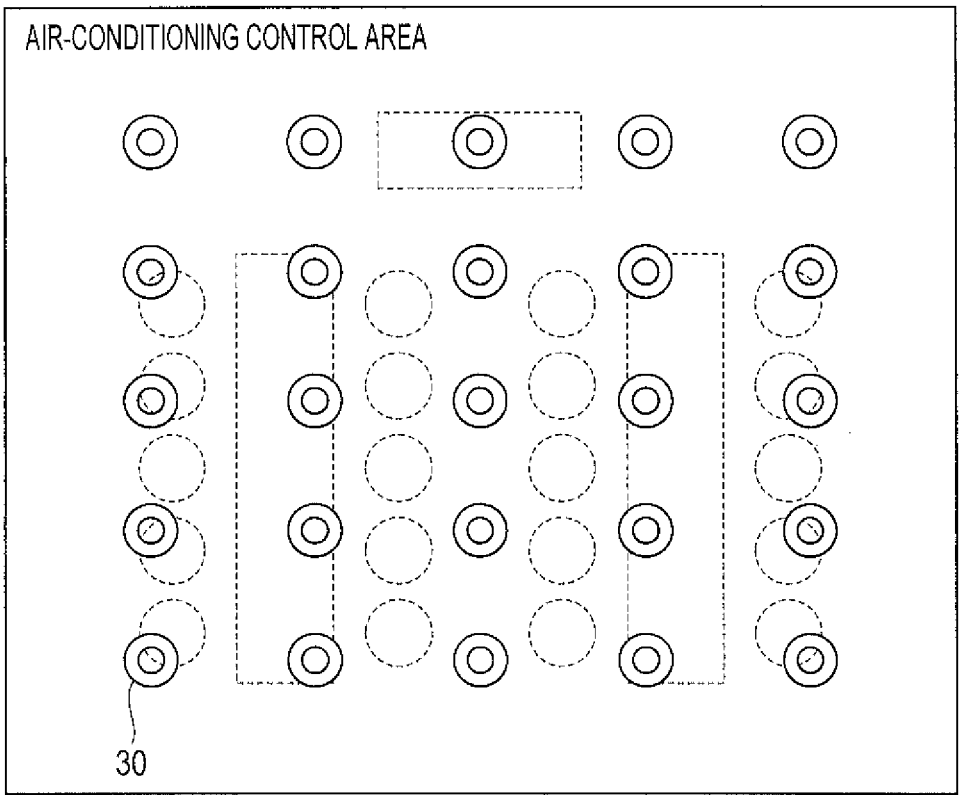
FIGS. 2A and 2B illustrate an example of the arrangement of environment sensors and that of position sensors, respectively.

FIG. 2A shows an example of the arrangement of environment sensors 30. In the example shown in FIG. 2A, a total of twenty-five environment sensors 30 (five rows and five columns) are installed in the office where twenty employees work. In this case, each of the twenty-five environment sensors 30 performs sensing so that environment sensor data will be generated for each environment sensor 30.

In the example in FIG. 2A, the location of the air conditioner 60 is not shown. The environment sensors 30 may be provided in association with the air conditioner 60 in either one of the following manners. The environment sensors 30 are provided for the air conditioners 60 on a one-to-one correspondence basis, or plural environment sensors 30 are provided for one air conditioner 60. Alternatively, one environment sensor 30 is provided for plural air conditioners 60.

The position sensor 40 serves as a receiver that receives radio waves (transmit signal) from a transmitter 50 carried by a user by wireless communication. Based on the radio waves received from the transmitter 50, the position sensor 40 detects the position of the transmitter 50 (that is, the position of the user carrying the transmitter 50) and generates position sensor data (position information) indicating the position of the user. The position sensor data is generated in the format (protocol) of, for example, fluentd, which is an open source log collection tool. The transmitter 50 is typically an active radio-frequency identification (RFID) tag. However, the transmitter 50 is not restricted to a RFID tag, and may be a transmitter of a desired position detection system, such as a mobile station of a mobile communication system and an infrared badge (ID tag).

Each transmitter 50 is carried by a single user, and thus, the same number of transmitters 50 as that of users are provided. Each of the transmitters 50 has a unique ID, and regularly (for example, every few seconds) transmits ID information to the position sensor 40 by wireless communication. The position sensor 40 receives ID information transmitted from a transmitter 50 which is located within the detection range of the position sensor 40. The position sensor 40 then identifies this transmitter 50 (that is, the user carrying this transmitter 50) on the basis of the received ID information so as to detect which transmitter 50 is located within the detection range of the position sensor 40, and then generates position sensor data. This position sensor data also indicates ID information unique to this position sensor 40. Accordingly, the image processing apparatus 10, which receives position sensor data regularly (for example, every few seconds) from the position sensor 40, is able to obtain position information indicating which transmitter 50 is located within the detection range of the position sensor 40, on the basis of the ID information concerning the transmitter 50 and that concerning the position sensor 40.

Although only one position sensor 40 is shown in FIG. 1, plural position sensors 40 may be provided. If plural position sensors 40 are provided, they are installed in different locations.

Figure 2B:
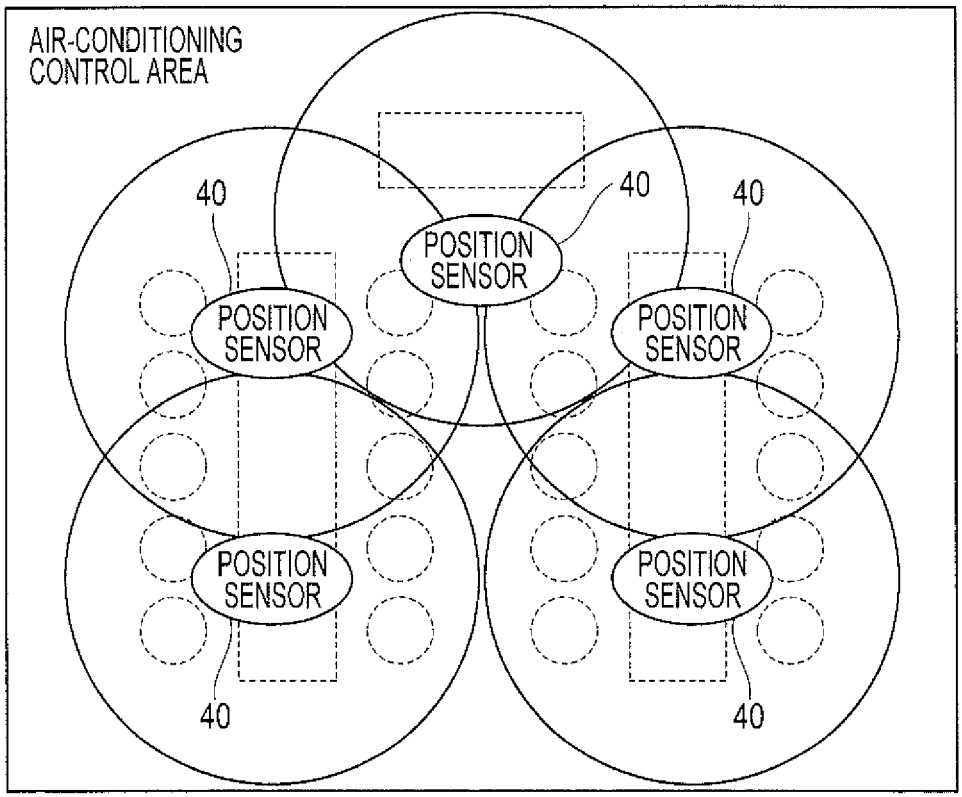

FIG. 2B shows an example of the arrangement of position sensors 40. In the example shown in FIG. 2B, as well as in that of FIG. 2A, the office where twenty employees work is shown. Twenty transmitters 50 are provided in the office, considering each employee carries one transmitter 50. When the employees move, the transmitters 50 carried by the employees also move. Five position sensors 40 are installed in the office, and each position sensor 40 receives radio waves from the transmitters 50 located within the detection range of the position sensor 40 indicated by the circle in FIG. 2B, and detects the positions of the transmitters 50.

The position sensor 40 may specify the positions of the transmitters 50 (the positions of users) by a different approach. For example, the position sensor 40 may specify the coordinates of the positions of the transmitters 50 within the detection range of the position sensor 40, based on the intensity of radio waves received from the transmitters 50.

In this exemplary embodiment, the transmitter 50 is used as a transmitting device that transmits identification information, and the position sensor 40 is used as a receiving device that receives identification information.

The air conditioner 60 is a device that controls air conditioning within the building where the air conditioner 60 is installed. The air conditioner 60 performs operations such as a cooling operation for cooling the inside of the building and a heating operation for heating the inside of the building. An example of the air conditioner 60 is an air-conditioning facility used for a building. Although only one air conditioner 60 is shown in FIG. 1, plural air conditioners 60 may be provided. In this exemplary embodiment, the air conditioner 60 is used as an example of an air-conditioning control device.

The first management server 70 is a server device that collects air-conditioning control information, environment sensor data, and position sensor data from the image processing apparatus 10 and processes the collected items of data. The first management server 70 then analyzes the situation of air conditioning within the building and the locations of users, and generates control information for controlling the air conditioner 60. The first management server 70 obtains, via the network 91, air-conditioning control information generated by the image processing apparatus 10, and environment sensor data and position sensor data subjected to processing based on the first management server 70 performed by the image processing apparatus 10. In this exemplary embodiment, it is assumed that the first management server 70 supports fluentd, which is the data format of the position sensor data.

The second management server 80, as well as the first management server 70, is a server device that collects air-conditioning control information, environment sensor data, and position sensor data from the image processing apparatus 10 and processes the collected items of data. The second management server 80 then analyzes the situation of air conditioning within the building and the locations of users, and generates control information for controlling the air conditioner 60. The second management server 80 obtains, via the network 91, air-conditioning control information generated by the image processing apparatus 10, and environment sensor data and position sensor data subjected to processing based on the second management server 80 performed by the image processing apparatus 10. In this exemplary embodiment, it is assumed that the second management server 80 supports REST, which is the data format of the environment sensor data.

The network 90 is a communication medium used for information communication between the image processing apparatus 10 and the terminal device 20. The network 90 is a LAN, for example.

The network 91 is a communication medium used for information communication between the image processing apparatus 10 and each of the first and second management servers 70 and 80. The network 91 is the Internet, for example.

In this exemplary embodiment, the image processing apparatus 10, the terminal device 20, the environment sensor 30, the position sensor 40, and the air conditioner 60 are disposed within a predetermined area, for example, in the office. In other words, the image processing apparatus 10, the terminal device 20, the environment sensor 30, and the position sensor 40 are disposed within the area where air-conditioning control is performed by the air conditioner 60, and the image processing apparatus 10 controls the air conditioner 60 installed within the same area as that of the image processing apparatus 10.

In FIG. 1, two server devices connected to the network 91 are shown. However, the number of server devices connected to the network 91 is not restricted to two. Three or more server devices having functions similar to those of the first and second management servers 70 and 80 may be connected to the network 91.

In FIG. 1, only the single area is shown in the air-conditioning system 1. However, the number of areas in the air-conditioning control system 1 is not restricted to one. For example, in a manner similar to that described above, sensor data may be collected in another office, and air-conditioning control information and sensor data may be sent to the first and second management servers 70 and 80 via the network 91.

(Hardware Configuration of Image Processing Apparatus)

Figure 3:
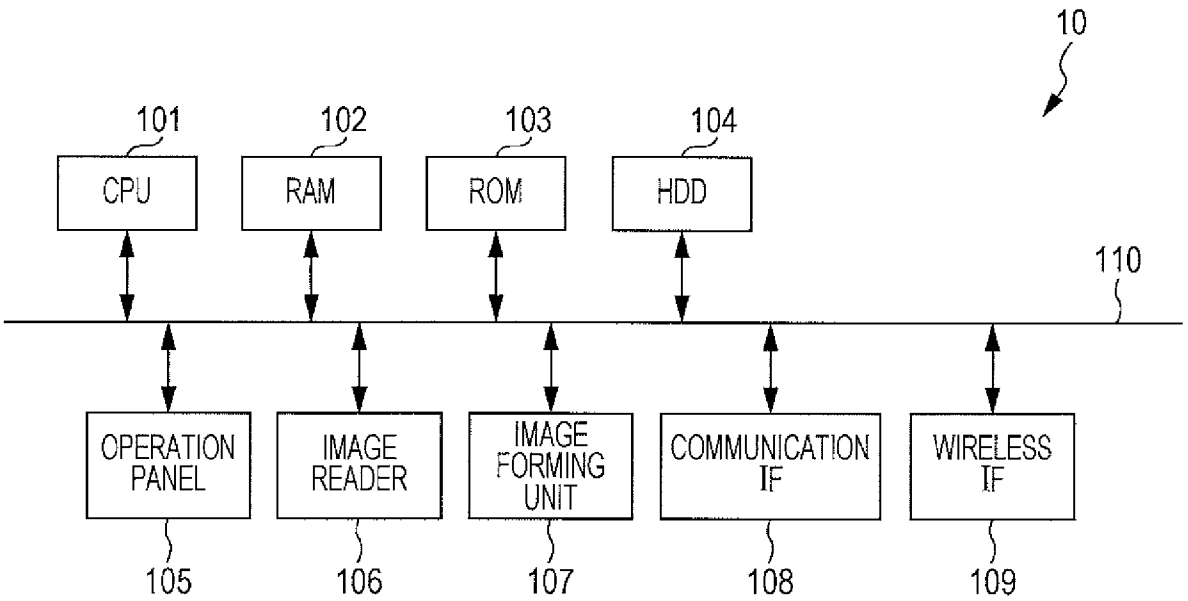
FIG. 3 is a block diagram illustrating an example of the hardware configuration of an image processing apparatus according to an exemplary embodiment.

An example of the hardware configuration of the image processing apparatus 10 will be described below with reference to the block diagram of FIG. 3. As shown in FIG. 3, the image processing apparatus 10 includes a central processing unit (CPU) 101, a random access memory (RAM) 102, a read only memory (ROM) 103, a hard disk drive (HDD) 104, an operation panel 105, an image reader 106, an image forming unit 107, a communication interface (hereinafter referred to as the "communication IF") 108, and a wireless interface (hereinafter referred to as the "wireless IF") 109. The above-described elements are connected to a bus 110 and send and receive data to and from each other via the bus 110.

The CPU 101 loads various programs stored in the ROM 103 and another medium into the RAM 102 and executes the loaded program so as to implement the functions of the image processing apparatus 10.

The RAM 102 is used as a work memory for the CPU 101.

The ROM 103 is a memory storing various programs to be executed by the CPU 101 therein.

The HDD 104 is, for example, a magnetic disk drive storing therein image data read by the image reader 106 and image data used for forming images by the image forming unit 107.

The operation panel 105 displays various items of information and receives input of an operation from a user. An example of the operation panel 105 is a touch panel. In this exemplary embodiment, the operation panel 105 serves as a control panel which receives input of print settings in the image processing apparatus 10 and also as a display which displays information concerning environment sensor data, position sensor data, and air-conditioning control information.

The image reader 106 reads an image recorded on a recording medium, such as paper. The image reader 106 is, for example, a scanner, and may be a charge coupled device (CCD) scanner or a contact image sensor (CIS) scanner. In a CCD scanner, light applied to a document from a light source and reflected by the document is reduced by a lens and is received by CCDs. In a CIS scanner, light sequentially applied to a document from light emitting diode (LED) light sources and reflected by the document is received by a CIS.

The image forming unit 107 is a print mechanism which forms an image on a recording medium, such as paper. The image forming unit 107 is, for example, a printer for forming an image based on an electrophotographic system or an inkjet method. In the electrophotographic system, an image is formed by transferring toner attached to a photoconductor drum to a recording medium. In the inkjet method, an image is formed by ejecting ink onto a recording medium.

The communication IF 108 serves as a communication interface that sends and receives various items of data to and from other devices via the network 90. The communication IF 108 receives, for example, image data from the terminal device 20 via the network 90. The communication IF 108 sends, for example, air-conditioning control information generated by the image processing apparatus 10 to the first and second management servers 70 and 80 via the network 90. If the environment sensor 30, the position sensor 40, and the air conditioner 60 are connected to the image processing apparatus 10 via a wired field network so that they can communication with the image processing apparatus 10, the communication IF 108 receives, for example, environment sensor data and position sensor data from the environment sensor 30 and the position sensor 40, respectively. The communication IF 108 may also send air-conditioning control information generated by the image processing apparatus 10 to the air conditioner 60 via a wired field network. In this exemplary embodiment, the communication IF 108 is used as an example of a sender, a receiver, a first obtaining unit, a second obtaining unit, and a power supply amount obtaining unit.

The wireless IF 109 is a wireless module for communicating with other devices by using a wireless communication network. The wireless IF 109 receives, for example, environment sensor data and position sensor data from the environment sensor 30 and the position sensor 40, respectively, by wireless communication. The wireless IF 109 may also send air-conditioning control information generated by the image processing apparatus 10 to the air conditioner 60 by wireless communication. In this exemplary embodiment, the wireless IF 109 is used as an example of the first obtaining unit, the second obtaining unit, and the power supply amount obtaining unit.

The wireless IF 109 may also serve as an infrared sensor which senses that a user is near the image processing apparatus 10. The infrared sensor outputs a signal when sensing that a user is approaching to use the image processing apparatus 10 or that a user using the image processing apparatus 10 has been separated from the image processing apparatus 10. Based on a signal output from the infrared sensor, the state of the image processing apparatus 10 is switched. More specifically, when the user is approaching the image processing apparatus 10, the state of the image processing apparatus 10 is switched from a standby (pause) state to a user operation state in which it is ready to receive a user operation. When the user has been separated from the image processing apparatus 10, the state of the image processing apparatus 10 is switched from the user operation state to the standby state.

(Functional Configuration of Image Processing Apparatus)

Figure 4:
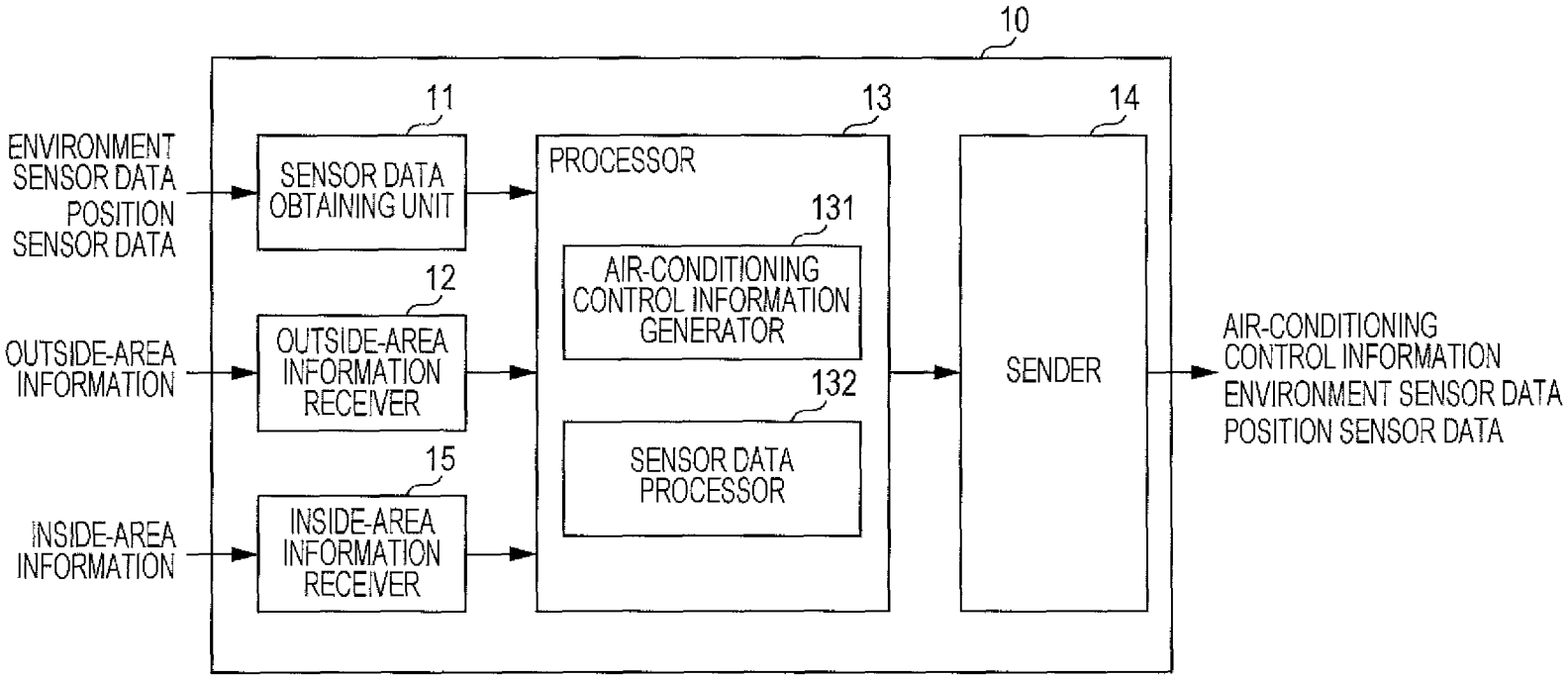
FIG. 4 is a block diagram illustrating an example of the functional configuration of the image processing apparatus.

An example of the functional configuration of the image processing apparatus 10 will be described below with reference to the block diagram of FIG. 4. As shown in FIG. 4, the image processing apparatus 10 includes a sensor data obtaining unit 11, an outside-area information receiver 12, a processor 13, a sender 14, and an inside-area information receiver 15.

The sensor data obtaining unit 11 obtains, via the wireless IF 109, environment sensor data from each of plural environment sensors 30 installed within the area and position sensor data from each of plural position sensors 40 installed within the area. In this case, the sensor data obtaining unit 11 obtains sensor data by receiving items of sensor data sequentially supplied from the environment sensors 30 and the position sensors 40.

The outside-area information receiver 12 receives outside-area information (external information) via the communication IF 108 by requesting devices outside the area to send information or by receiving information regularly supplied from the devices outside the area. The outside-area information is, for example, information concerning air conditioning outside the area. Examples of the outside-area information are information concerning the situation of power supply and demand, disaster information concerning fires and earthquakes, and information concerning the air-conditioning states of other areas.

More specifically, the outside-area information receiver 12 receives, via the network 91, for example, information concerning the situation of power supply and demand from an electric power company. The outside-area information receiver 12 also receives from the first management server 70, via the network 91, for example, air-conditioning control information generated for controlling an air conditioner in another area which is used in an environment similar to that of the air conditioner 60. In this case, the first management server 70 determines that the environment of the air conditioner 60 is similar to that in another area in the following manner. Regarding each area of the air-conditioning control system 1, the first management server 70 classifies the values of some types of sensor data. Examples of the types of sensor data are the number of people within the area, temperature, atmospheric pressure, and UV density. Then, if there is an area where at least one of the above-described types of sensor data belongs to the same class as that in the area of the air conditioner 60, the first management server 70 determines that the environment of this area is similar to that of the air conditioner 60.

The processor 13, which is an example of an output unit, generates air-conditioning control information based on the environment sensor data and the position sensor data obtained by the sensor data obtaining unit 11. The processor 13 also performs conversion processing for converting the formats (protocols) of the environment sensor data and the position sensor data into formats supported by a destination, and performs data processing based on the destination. In other words, the processor 13 performs conversion processing and data processing so that information supported and required by the destination will be included in the environment sensor data and the position sensor data. The processor 13 includes an air-conditioning control information generator 131 and a sensor data processor 132. Details of the processing performed by the processor 13 will be discussed later.

The sender 14 sends via the communication IF 108 the air-conditioning control information generated by the processor 13 to the first and second management servers 70 and 80. The sender 14 also sends via the communication IF 108 the environment sensor data and the position sensor data processed by the processor 13 to the first and second management servers 70 and 80.

The inside-area information receiver 15 receives inside-area information via the wireless IF 109 or the communication IF 108 by requesting the devices within the area other than the environment sensor 30 and the position sensor 40 to send information or by receiving information regularly supplied from the devices within the area. Examples of the inside-area information are the running (operating) state (power ON/OFF state) of the terminal device 20, the amount of power supply or the current value measured in the air conditioner 60, and the print log of the image processing apparatus 10. The amount of power supply measured in the air conditioner 60 is the amount of power supplied to the air conditioner 60, and information concerning the amount of power supply is sent from the air conditioner 60 to the inside-area information receiver 15 by wireless communication, for example.

(Processing for Generating Air-Conditioning Control Information)

Processing for generating air-conditioning control information will be described below in detail.

The air-conditioning control information generator 131 of the processor 13 generates air-conditioning control information based on environment sensor data and position sensor data obtained by the sensor data obtaining unit 11. In this case, in the air-conditioning control information generator 131, conditions for generating air-conditioning control information are determined in advance. The air-conditioning control information generator 131 first determines whether or not the obtained environment sensor data and position sensor data satisfy the predetermined conditions, and generates air-conditioning control information in accordance with the determination results.

Figure 5A:
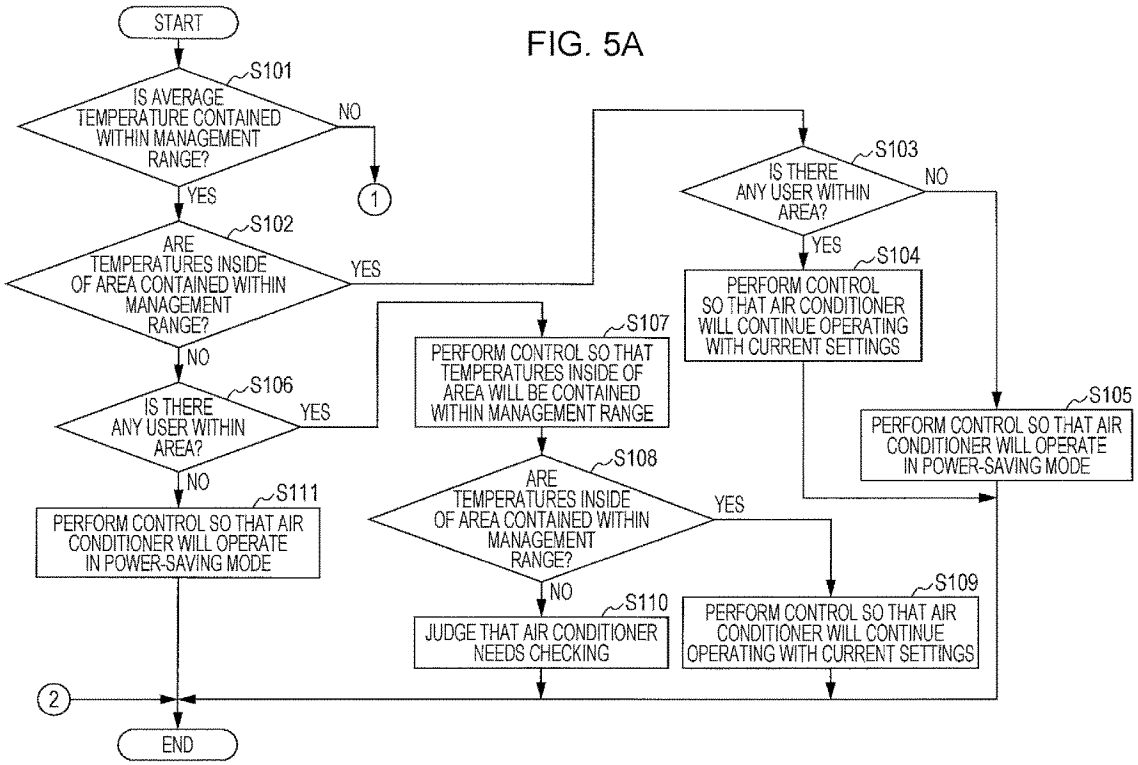
FIGS. 5A and 5B are a flowchart illustrating an example of a procedure of processing for generating air-conditioning control information by an air-conditioning control information generator.
Figure 5B:
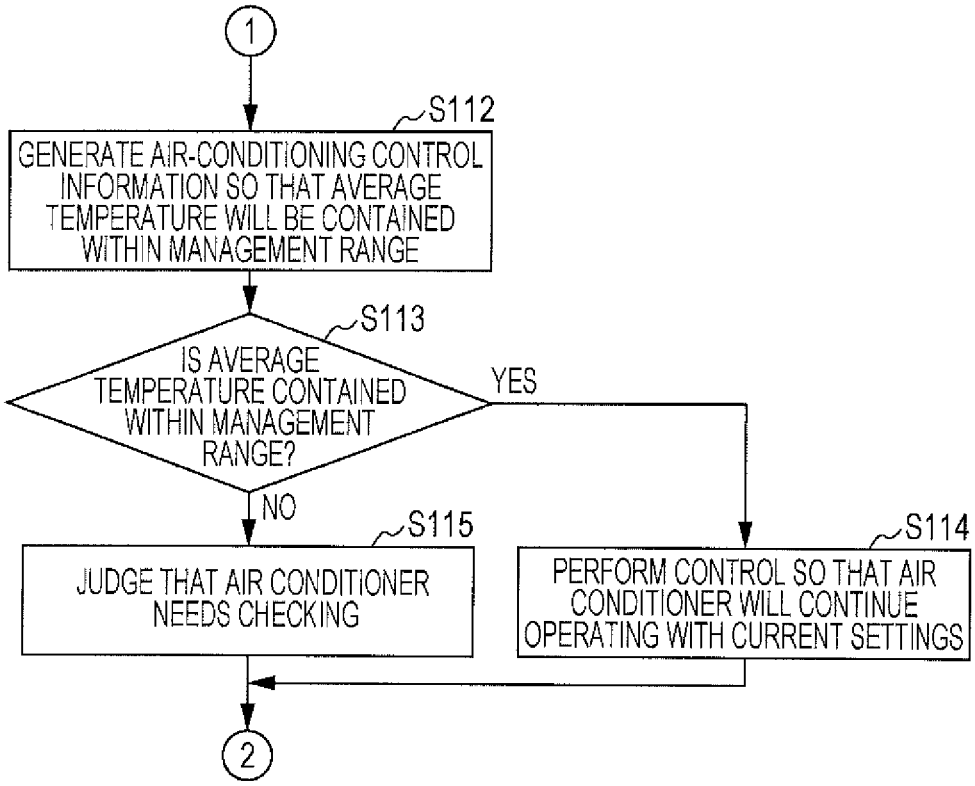

FIGS. 5A and 5B are a flowchart illustrating an example of a procedure of processing for generating air-conditioning control information by the air-conditioning control information generator 131. The processing procedure shown in FIGS. 5A and 5B will be discussed, assuming that air-conditioning control information is generated by using temperature information among plural pieces of environment information indicated by the environment sensor data. The air-conditioning control information generator 131 repeatedly executes the processing shown in FIGS. 5A and 5B at regular intervals (for example, every second).

Figure 6A:
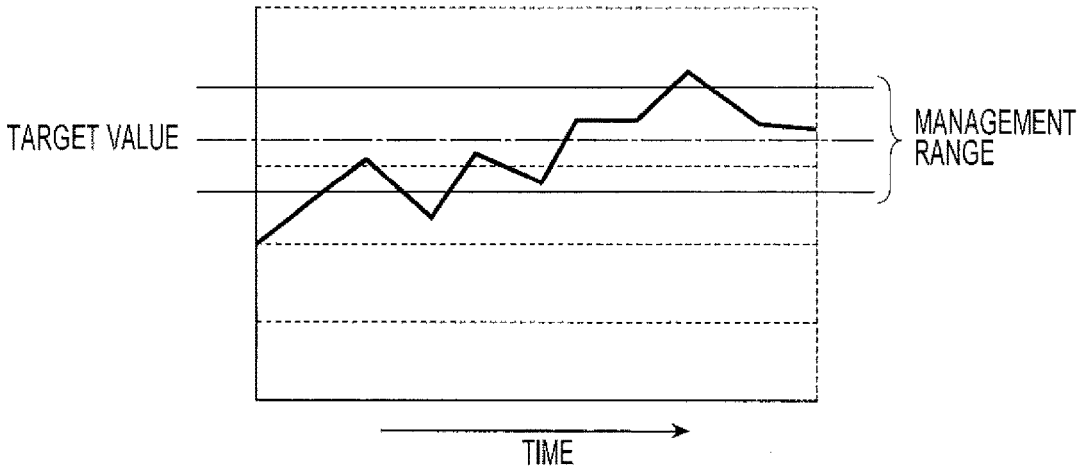
FIG. 6A illustrates an example of the average temperature within an area.

In step S101, the air-conditioning control information generator 131 first calculates the average temperature within the area, based on plural items of latest environment sensor data obtained from the plural environment sensors 30. The air-conditioning control information generator 131 then determines whether or not the average temperature is contained within a management range. FIG. 6A shows an example of the average temperature within the area. In FIG. 6A, the average value of the temperatures measured at the same time (or almost at the same time within a certain time period based on a reference time) in the environment sensors 30 is shown in chronological order. A target temperature value is set by a user, for example, in advance, and a predetermined range based on the target temperature value is defined as the management range.

Figure 6B:
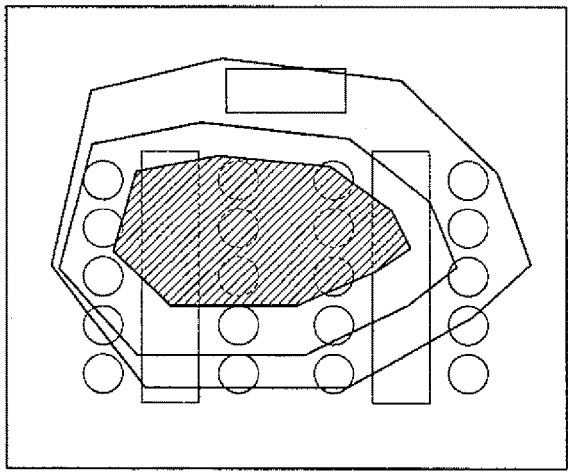
FIG. 6B illustrates an example of the temperature distribution within an area.

If the average temperature is contained within the management range (YES in step S101), the air-conditioning control information generator 131 proceeds to step S102 to determine whether or not the temperatures of the entire area are contained within the management range, based on the temperature distribution within the area. FIG. 6B shows an example of the temperature distribution within the area. In FIG. 6B, the temperature distribution created based on the latest temperatures measured at the same time (or almost at the same time within a certain time period based on a reference time) in the environment sensors 30 is shown. In the example shown in FIG. 6B, the temperature in the region indicated by the hatched portion is outside the management range.

Figure 6C:
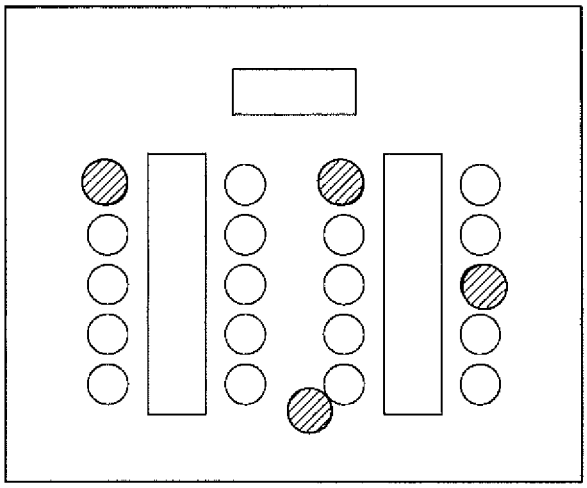
FIG. 6C illustrates an example of the user distribution within an area.

If the temperatures of the entire area are contained within the management range (YES in step S102), the air-conditioning control information generator 131 proceeds to step S103 to determine whether or not there is any user within the area, based on the latest position sensor data obtained from the position sensors 40. FIG. 6C shows an example of the user distribution within the area. In FIG. 6C, the positions of the users detected at the same time (or almost at the same time within a certain time period based on a reference time) obtained in the position sensors 40 most recently are shown by the hatched portions. In the example shown in FIG. 6C, there are four users within the area.

If there is any user within the area (YES in step S103), the air-conditioning control information generator 131 proceeds to step S104. In step S104, the air-conditioning control information generator 131 generates air-conditioning control information for controlling the air conditioner 60 so that the air conditioner 60 will continue operating with the current settings. As a result, the processing has been completed. The generated air-conditioning control information is sent to the first and second management servers 70 and 80 via the sender 14. In the above-described processing, since the air-conditioner 60 continues operating with the current settings, the air-conditioning control information generator 131 may not necessarily generate air-conditioning control information.

If it is determined in step S103 that there is no user within the area (NO in step S103), the air-conditioning control information generator 131 proceeds to step S105. In step S105, the air-conditioning control information generator 131 generates air-conditioning control information for controlling the air conditioner 60 so that the air conditioner 60 will operate in a power-saving mode. As a result, the processing has been completed. The power-saving mode is a mode in which less power is consumed than in the normal state (current state). In other words, in the power-saving mode, power consumed by the air conditioner 60 is reduced to a smaller level than a predetermined level. The generated air-conditioning control information is sent to the first and second management servers 70 and 80 via the sender 14.

If it is determined in step S102 that there is a region within the area where the temperature is outside the management range (NO in step S102), the air-conditioning control information generator 131 proceeds to step S106 to determine whether or not there is any user within the area, based on the latest position sensor data obtained from the position sensors 40.

If there is any user within the area (YES in step S106), the air-conditioning control information generator 131 proceeds to step S107. In step S107, the air-conditioning control information generator 131 generates air-conditioning control information for controlling the air conditioner 60, for example, for increasing the air flow of the air conditioner 60, so that the temperatures within the entire area will be contained within the management range. The generated air-conditioning control information is sent to the first and second management servers 70 and 80 via the sender 14. Then, after the lapse of a predetermined time, the air-conditioning control information generator 131 determines in step S108 whether or not the temperatures of the entire area are contained within the management range, as in step S102. If the result of step S108 is YES, the air-conditioning control information generator 131 proceeds to step S109. In step S109, the air-conditioning control information generator 131 generates air-conditioning control information for controlling the air conditioner 60 so that the air conditioner 60 will continue operating with the current settings. As a result, the processing has been completed. As in step S104, in step S109, the air-conditioning control information generator 131 may not necessarily generate air-conditioning control information. If it is determined in step S108 that the temperatures of the area are not entirely contained within the management range, the air-conditioning control information generator 131 proceeds to step S110 to judge that the air conditioner 60 needs checking. Then, the air-conditioning control information generator 131 displays this information on the operation panel 105 so as to inform the user that the air conditioner 60 needs checking. As a result, the processing has been completed.

If there is no user within the area (NO in step S106), the air-conditioning control information generator 131 proceeds to step S111. In step S111, the air-conditioning control information generator 131 generates air-conditioning control information for controlling the air conditioner 60 so that the air conditioner 60 will operate in the power-saving mode, as in step S105. As a result, the processing has been completed.

If it is determined in step S101 that the average temperature is not contained within the management range (NO in step S101), the air-conditioning control information generator 131 proceeds to step S112. In step S112, the air-conditioning control information generator 131 generates air-conditioning control information for controlling the air conditioner 60, for example, for increasing the air flow of the air conditioner 60, so that the average temperature within the area will be contained within the management range. The generated air-conditioning control information is sent to the first and second management servers 70 and 80 via the sender 14.

Then, after the lapse of a predetermined time, the air-conditioning control information generator 131 determines step S113 whether or not the average temperature is contained within the management range. If the result of step S113 is YES, the air-conditioning control information generator 131 proceeds to step S114. In step S114, the air-conditioning control information generator 131 generates air-conditioning control information for controlling the air conditioner 60 so that the air conditioner 60 will continue operating with the current settings. As a result, the processing has been completed. As in steps S104 and S109, the air-conditioning control information generator 131 may not necessarily generate air-conditioning control information. If it is determined in step S113 that the average temperature is not contained within the management range, the air-conditioning control information generator 131 proceeds to step S115 to judge that the air conditioner 60 needs checking. Then, as in step S110, the air-conditioning control information generator 131 displays this information on the operation panel 105 so as to inform the user that the air conditioner 60 needs checking. As a result, the processing has been completed.

If there are plural air conditioners 60 within the area, different items of air-conditioning control information may be generated for the individual air conditioners 60.

For example, when generating air-conditioning control information in step S104, the air-conditioning control information generator 131 may generate air-conditioning control information for controlling the air conditioner 60 located near the user within the area so that the air conditioner 60 will operate with the current settings, and may generate air-conditioning control information for controlling the air conditioner 60 located separated from the user so that the air conditioner 60 will operate in the power-saving mode. When generating air-conditioning control information in step S107, the air-conditioning control information generator 131 may generate air-conditioning control information only for the air conditioner 60 installed in a region within the area where the temperature is outside the management range to control the air conditioner 60 so that the temperature in this region will be contained within the management range.

In the processing shown in FIGS. 5A and 5B, the air-conditioning control information generator 131 generates air-conditioning control information by using temperature information. However, another type of environment information, such as, the humidity, atmospheric pressure, and UV density, may be used for generating air-conditioning control information. If a condition for generating air-conditioning control information is determined for each type of environment information and if any one of the conditions is satisfied, the air-conditioning control information generator 131 may generate air-conditioning control information in accordance with this condition.

The air-conditioning control information generator 131 may compare time-series environment sensor data obtained from an environment sensor 30 with that from another environment sensor 30 among the plural environment sensors 30, and may correct air-conditioning control information on the basis of the comparison results. In this case, the air-conditioning control information generator 131 first finds the standard deviation of the time-series environment information (for example, the temperature) for each environment sensor 30 so as to calculate the degree of a variation in the environment information. Then, regarding the environment sensor 30 that has output the environment information for which the highest degree of the variation is calculated, the air-conditioning control information generator 131 corrects the air-conditioning control information so that the degree of the variation in the environment information output from this environment sensor 30 will be decreased. More specifically, the air-conditioning control information generator 131 generates air-conditioning control information for controlling the air conditioner 60 which is disposed near this environment sensor 30 and which controls air conditioning around this environment sensor 30, so that the degree of the variation can be decreased. In this case, the air-conditioning control information generator 131 is used as an example of a comparator.

The air-conditioning control information generator 131 may correct air-conditioning control information, based on outside-area information received by the outside-area information receiver 12 or inside-area information received by the inside-area information receiver 15.

For example, the air-conditioning control information generator 131 may correct air-conditioning control information, based on information concerning the situation of power supply and demand received by the outside-area information receiver 12. In this case, if, for example, the power consumption (or power usage ratio) in the region where the air conditioner 60 is installed, such as the Kanto region (Tokyo and the surrounding areas in Japan), exceeds a predetermined value, the air-conditioning control information generator 131 corrects the air-conditioning control information so that the air conditioner 60 will operate in the power-saving mode.

The air-conditioning control information generator 131 may correct air-conditioning control information for controlling the air conditioner 60, based on air-conditioning control information generated for an air conditioner in another area which is used in an environment similar to that of the air conditioner 60. In this case, if the air-conditioning control information for the air conditioner in another area indicates that the temperature will be increased, the air-conditioning control information generator 131 corrects the air-conditioning control information for the air conditioner 60 so that the temperature will also be increased.

The air-conditioning control information generator 131 may correct air-conditioning control information, based on the running states (power ON/OFF states) of terminal devices 20 within the area. In this case, the air-conditioning control information generator 131 first determines whether or not it can communicate with the terminal devices 20 installed within the area so as to detect the number of terminal devices 20 in operation. If the number of terminal devices 20 in operation (or the ratio of the terminal devices 20 in operation) is equal to or smaller than a predetermined value, the air-conditioning control information generator 131 corrects the air-conditioning control information so that the air conditioner 60 will operate in the power-saving mode.

The air-conditioning control information generator 131 may correct air-conditioning control information, based on information concerning the amount of power supply measured in the air conditioner 60. In this case, if, for example, the amount of power supply measured in the air conditioner 60 exceeds a predetermined value, the air-conditioning control information generator 131 corrects the air-conditioning control information so that the air conditioner 60 will operate in the power-saving mode.

When performing the above-described processing, the air-conditioning control information generator 131 may utilize a stream-data processing technique. Stream data is time-series data, and the air-conditioning control information generator 131 is required to sequentially receive or write the time-series data. Stream-data processing is a technique for processing data in real time when data is generated. With the stream-data processing technique, a large amount of data can be processed almost without delay. By using this technique, upon receiving position sensor data and environment sensor data, the air-conditioning control information generator 131 consecutively determines whether or not the received position sensor data and environment sensor data satisfy conditions for generating air-conditioning control information and consecutively generates air-conditioning control information in accordance with the determination results.

(Destination-Based Processing for Sensor Data)

Destination-based processing for sensor data will be described below in detail. When the sensor data processor 132 of the processor 13 sends sensor data obtained from the sensor data obtaining unit 11 to the first management server 70, it first performs processing based on the first management server 70 on the sensor data. Similarly, when the sensor data processor 132 sends sensor data obtained from the sensor data obtaining unit 11 to the second management server 80, it first performs processing based on the second management server 80 on the sensor data.

Figure 7:
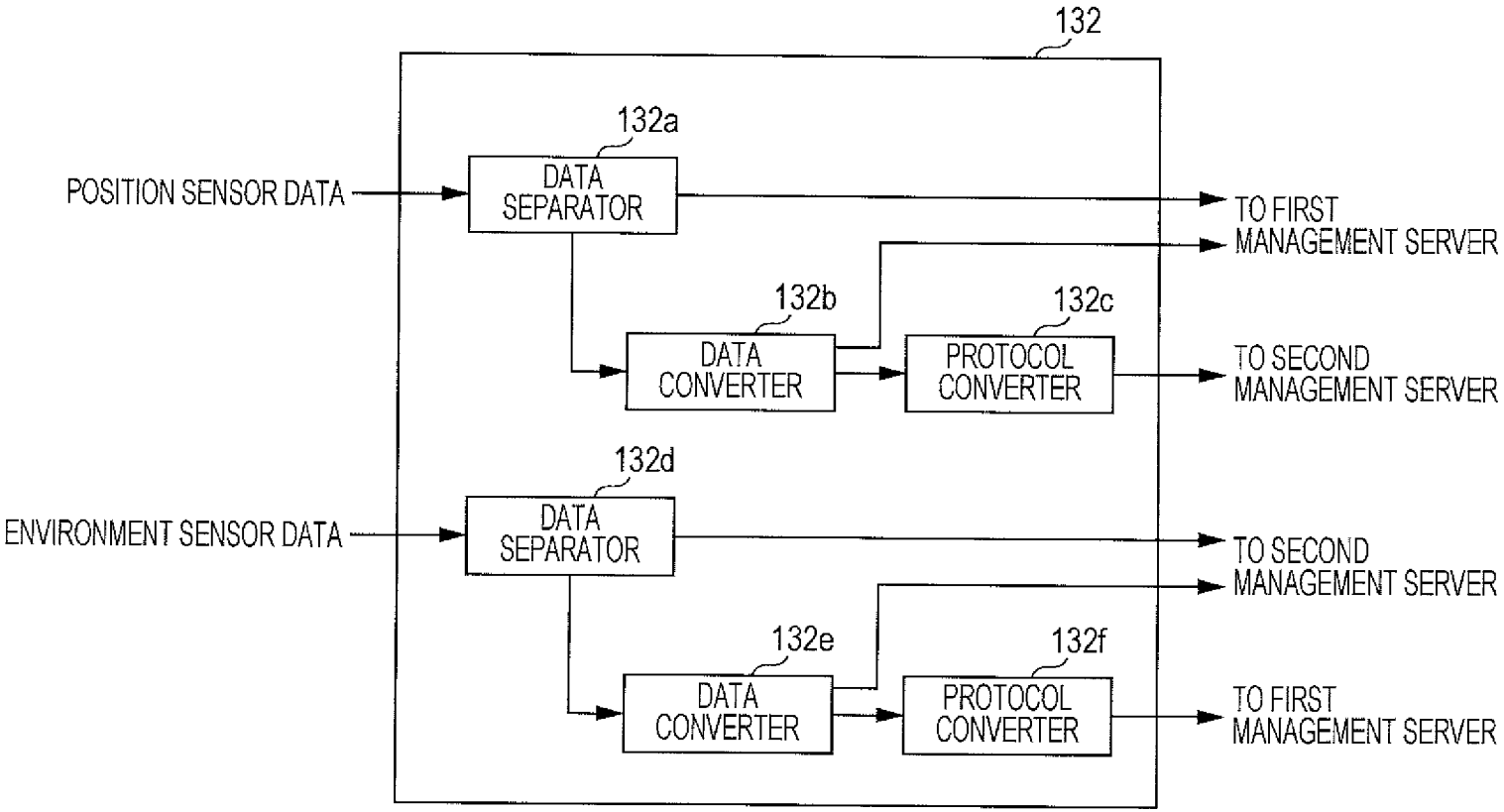
FIG. 7 is a block diagram illustrating an example of the configuration of a sensor data processor.

FIG. 7 is a block diagram illustrating an example of the configuration of the sensor data processor 132. As shown in FIG. 7, the sensor data processor 132 includes a data separator 132*a*, a data converter 132*b*, a protocol converter 132*c*, a data separator 132*d*, a data converter 132*e*, and a protocol converter 132*f*. The data separator 132*a*, the data converter 132*b*, and the protocol converter 132*c* form a function unit that processes position sensor data. The data separator 132*d*, the data converter 132*e*, and the protocol converter 132*f* form a function unit that processes environment sensor data.

Processing for position sensor data will first be discussed below.

Upon receiving position sensor data from the sensor data obtaining unit 11, the data separator 132*a* copies the position sensor data, and outputs one copy of the position sensor data to the sender 14 (see FIG. 4) and the other to the data converter 132*b*. The format of the position sensor data is fluentd, and the first management server 70 supports fluentd. Accordingly, if the first management server 70 is a destination of the position sensor data, the data separator 132*a* outputs the position sensor data to the sender 14 by maintaining the format of the position sensor data.

The data converter 132*b* performs destination-based data processing on the position sensor data input from the data separator 132*a*. More specifically, if the first management server 70 is a destination of the position sensor data, the data converter 132*b* performs data processing based on the first management server 70 on the position sensor data. If the second management server 80 is a destination of the position sensor data, the data converter 132*b* performs data processing based on the second management server 80 on the position sensor data.

The type of data processing to be performed by the data converter 132*b* is determined in advance by, for example, user settings, in accordance with the destination. Examples of destination-based processing are statistical processing and restriction processing for restricting information to be included in sensor data to a specific type of information.

If, for example, data processing based on the first management server 70 is processing for counting the number of users within a certain area according to the time zone, the data converter 132*b* counts the number of users within the area according to the time zone, based on information included in the position sensor data. The data converter 132*b* then sets the counting results as the position sensor data. If, for example, data processing based on the second management server 80 is processing for restricting information to be included in the position sensor data to a specific type of information, the data converter 132*b* restricts the position sensor data to this specific type of information by deleting the other items of information from the position sensor data.

Destination-based processing may include processing for not altering position sensor data input from the data separator 132*a* or processing for not sending position sensor data to a destination. As destination-based processing, the data converter 132*b* may generate plural items of position sensor data. For example, as data processing based on the second management server 80, the data converter 132*b* may perform processing for not altering position sensor data and also perform statistical processing on the position sensor data so as to generate two items of position sensor data.

After performing destination-based data processing, the data converter 132*b* outputs the position sensor data subjected to the data processing based on the first management server 70 to the sender 14 by maintaining the data format (fluentd). The data converter 132*b* also outputs the position sensor data subjected to the data processing based on the second management server 80 to the protocol converter 132*c*.

The protocol converter 132*c* converts the data format of the position sensor data subjected to the data processing based on the second management server 80 to the data format supported by the second management server 80

(REST). That is, the protocol converter 132*c* converts the data format of the position sensor data from fluentd to REST, and then outputs the converted position sensor data to the sender 14.

If the second management server 80 is a destination of the position sensor data obtained from the sensor data obtaining unit 11, the data separator 132*a* may directly output the copy of the position sensor data to the protocol converter 132*c* without via the data converter 132*b*.

Processing for environment sensor data will now be discussed below.

Upon receiving environment sensor data from the sensor data obtaining unit 11, the data separator 132*d* copies the environment sensor data, and outputs one copy of the environment sensor data to the sender 14 and the other to the data converter 132*e*. The format of the environment sensor data is REST, and the second management server 80 supports REST. Accordingly, if the second management server 80 is a destination of the environment sensor data, the data separator 132*d* outputs the environment sensor data to the sender 14 by maintaining the format of the environment sensor data.

The data converter 132*e* performs destination-based data processing on the environment sensor data input from the data separator 132*d*. More specifically, if the first management server 70 is a destination of the environment sensor data, the data converter 132*e* performs data processing based on the first management server 70 on the environment sensor data. Similarly, if the second management server 80 is a destination of the environment sensor data, the data converter 132*e* performs data processing based on the second management server 80 on the environment sensor data. In this case, the type of data processing to be performed by the data converter 132*e* is determined in advance in accordance with the destination, as in the processing performed by the data converter 132*b*.

After performing destination-based data processing, the data converter 132*e* outputs the environment sensor data subjected to the data processing based on the first management server 70 to the protocol converter 132*f*. The data converter 132*e* also outputs the environment sensor data subjected to the data processing based on the second management server 80 to the sender 14 by maintaining the data format (REST).

The protocol converter 132*f* converts the data format of the environment sensor data subjected to the data processing based on the first management server 70 to the data format supported by the first management server 70 (fluentd). That is, the protocol converter 132*f* converts the data format of the environment sensor data from REST to fluentd, and then outputs the converted environment sensor data to the sender 14.

If the first management server 70 is a destination of the environment sensor data obtained from the sensor data obtaining unit 11, the data separator 132*d* may directly output the copy of the environment sensor data to the protocol converter 132*f* without via the data converter 132*e*.

In this manner, the sensor data processor 132 performs protocol conversion processing and data processing on position sensor data and environment sensor data in accordance with each of the first and second management servers 70 and 80. More specifically, the position sensor data and the environment sensor data are first subjected to protocol conversion processing and data processing based on the first management server 70 and are then sent to the first management server 70 via the sender 14. The first management server 70 performs, for example, analysis processing, by using the position sensor data and the environment sensor data received in the data format of fluentd. The position sensor data and the environment sensor data are first subjected to protocol conversion processing and data processing based on the second management server 80 and are then sent to the second management server 80 via the sender 14. The second management server 80 performs, for example, analysis processing, by using the position sensor data and the environment sensor data received in the data format of REST.

In a manner similar to the processing performed by the air-conditioning control information generator 131, the sensor data processor 132 may perform the above-described processing by utilizing a stream-data processing technique.

In this case, the data separator 132*a* consecutively copies obtained position sensor data and outputs the position sensor data to the sender 14 and to the data converter 132*b*. The data converter 132*b* consecutively processes the received position sensor data and outputs it to the sender 14 and to the protocol converter 132*c*. The protocol converter 132*c* consecutively converts the data format of the received position sensor data from fluentd to REST, and outputs the position sensor data to the sender 14.

The data separator 132*d* consecutively copies obtained environment sensor data and outputs the environment sensor data to the sender 14 and to the data converter 132*e*. The data converter 132*e* consecutively processes the received environment sensor data and outputs it to the sender 14 and to the protocol converter 132*f*. The protocol converter 132*f* consecutively converts the data format of the received environment sensor data from REST to fluentd, and outputs the environment sensor data to the sender 14.

(Specific Examples of Data Format)

The data formats of sensor data will be discussed below through illustration of specific examples. FIG. 8 illustrates a table indicating an example of the data format of position sensor data. FIG. 9 illustrates a table indicating an example of the data format of environment sensor data. As the data format of position sensor data, the data format "fluentd" will be discussed as an example, and as the data format of environment sensor data, the data format "REST" will be discussed as an example.

The data format of position sensor data will first be discussed below with reference, to FIG. 8.

In the table shown in FIG. 8, "field name" indicates the name of a field included in the position sensor data. In the "timestamp" field, the time and date at and on which the position sensor data is generated is stored. In the "observation" field, the value measured by the position sensor 40 is stored. In the "receiverID" field, the ID of the position sensor 40 which receives radio waves from the transmitter 50 and generates the position sensor data is stored. In the "sensorID" field, the ID of the transmitter 50 is stored.

"Mandatory/optional" indicates whether or not each field is mandatory or optional in the position sensor data. "Type" indicates the data type of each field, for example, "string" indicates a character-string data type, while "long" indicates an integer data type.

The example shown in FIG. 8 indicates that the position sensor data was generated at 4 h47 m20 s on Jan. 14, 2016 and that the ID of the position sensor 40 is 55 and the ID of the transmitter 50 is 144.

The data format of environment sensor data will now be discussed below with reference to FIG. 9.

In the table shown in FIG. 9, "field name" indicates the name of a field included in the environment sensor data. In the "dataclass" field, the type of measured value obtained by the environment sensor 30, such as the temperature or humidity, is stored. In the "value" field, the value measured by the environment sensor 30 is stored. In the "location" field, information concerning the geographical location, such as the latitude and the longitude, at which the environment sensor 30 is installed is stored. In the "datum" field, geodetic information for locating places on the Earth, such as WGS84, is stored. In the "elevation" field, the value (metric representation) representing the height of the location where the environment sensor 30 is installed is stored. In the "at" field, the time and date at and on which the environment sensor data is generated is stored. In the "unit" field, the unit of the measured value is stored. In the "accuracy" field, the accuracy (percentage representation) of the measured value is stored. The accuracy of the measured value is a fixed value according to the environment sensor 30. The fields other than "dataclass", "value", and "at" are optional and may be omitted.

The example shown in FIG. 9 indicates that the environment sensor data was generated at 10 h20 m30 s on Jan. 10, 2016 and that the air temperature measured 20° C. The example shown in FIG. 9 also indicates that the environment sensor 30 is installed at 35 degrees north latitude and 135 degrees east longitude and at a height of 5 m and that the geodetic datum is WGS84 and the accuracy of the environment sensor 30 is 50%.

Data format conversion from fluentd to REST and vice versa is performed so that the content of position sensor data in fluentd can be transferred to that in REST and environment sensor data in REST can be transferred to that in fluentd without causing any loss in position information and environment information. For example, in the case of the data format conversion from REST to fluentd, the "at" field in REST corresponds to the "timestamp" field in fluentd, and the "value" field in REST corresponds to the "observation" field in fluentd.

(Procedure of Destination-Based Processing for Sensor Data)

Figure 10:
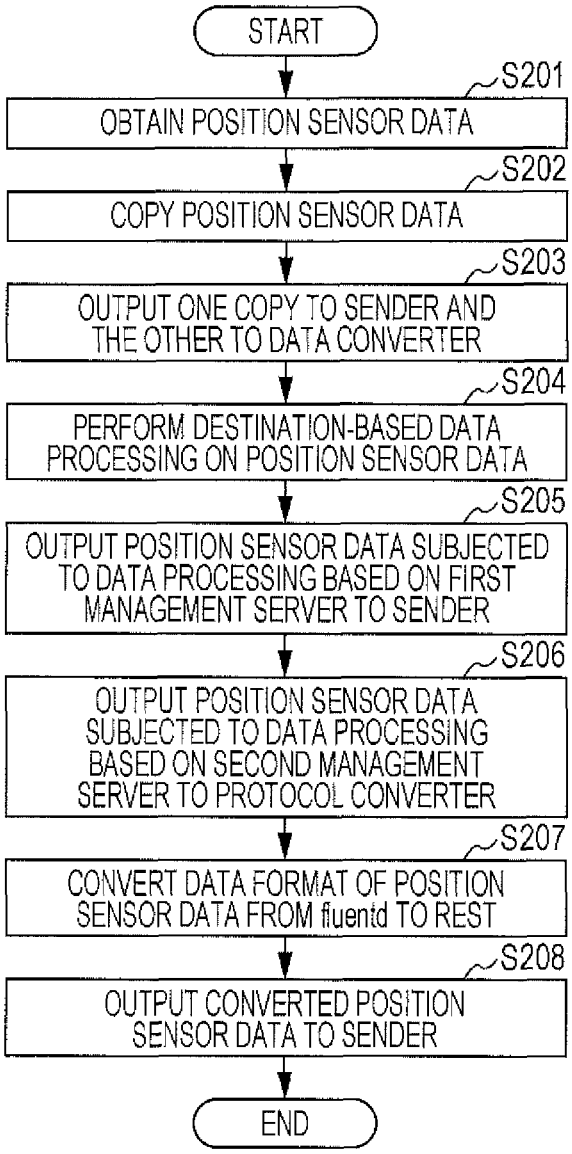
FIG. 10 is a flowchart illustrating an example of a procedure of destination-based processing for position sensor data performed by the sensor data processor.
Figure 11:
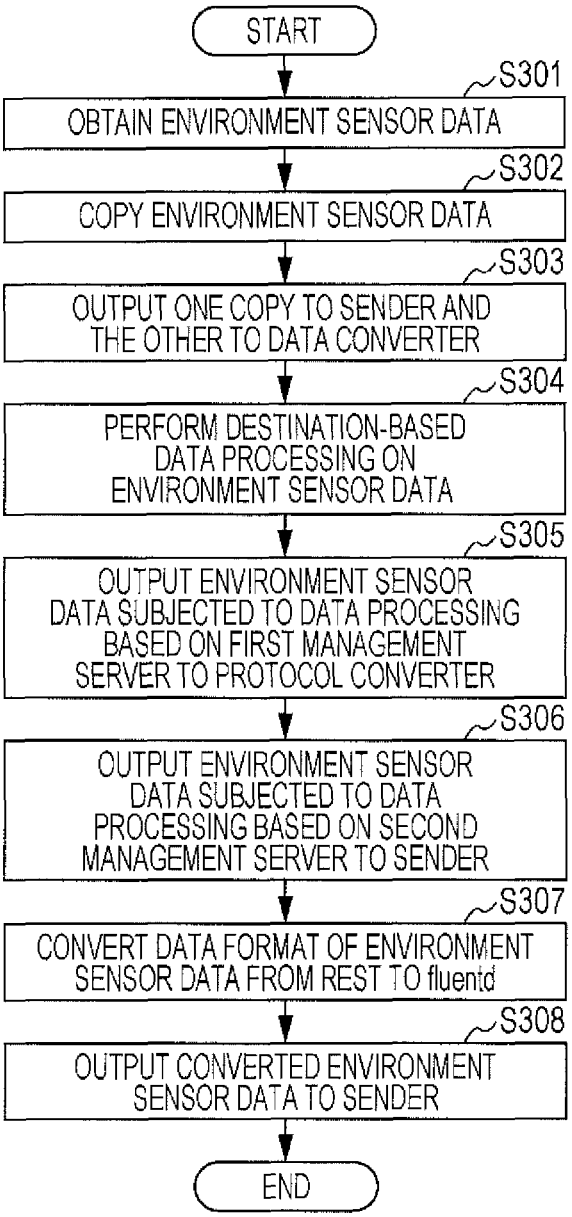
FIG. 11 is a flowchart illustrating an example of a procedure of destination-based processing for environment sensor data performed by the sensor data processor.

A procedure of destination-based processing for sensor data performed by the sensor data processor 132 will be described below. FIG. 10 is a flowchart illustrating an example of a procedure of destination-based processing for position sensor data performed by the sensor data processor 132. FIG. 11 is a flowchart illustrating an example of a procedure of destination-based processing for environment sensor data performed by the sensor data processor 132.

The procedure shown in FIG. 10 will first be discussed below.

In step S201, the data separator 132*a* obtains position sensor data from the sensor data obtaining unit 11. Then, in step S202, the data separator 132*a* copies the position sensor data. Then, in step S203, the data separator 132*a* outputs one copy of the position sensor data to the sender 14 and the other to the data converter 132*b*.

Then, in step S204, the data converter 132*b* performs destination-based data processing on the position sensor data. If the first management server 70 is a destination of the position sensor data, the data converter 132*b* performs data processing based on the first management server 70 on the position sensor data. If the second management server 80 is a destination of the position sensor data, the data converter 132*b* performs data processing based on the second management server 80 on the position sensor data.

Then, in step S205, the data converter 132*b* outputs the position sensor data subjected to the data processing based on the first management server 70 to the sender 14. In step S206, the data converter 132*b* also outputs the position sensor data subjected to the data processing based on the second management server 80 to the protocol converter 132*c*. When executing steps S205 and S206, either one of steps S205 and S206 may be executed first, or steps S205 and S206 may be executed in parallel.

In step S207, the protocol converter 132*c* converts the data format of the position sensor data from fluentd to REST. In step S208, the protocol converter 132*c* outputs the converted position sensor data to the sender 14. As a result, the processing has been completed.

Upon receiving the position sensor data, the sender 14 sends the position sensor data to a destination according to the data format of the position sensor data. That is, the sender 14 sends the position sensor data in the data format fluentd to the first management server 70 and sends the position sensor data in the data format REST to the second management server 80.

If, as stated above, the sensor data processor 132 performs stream-data processing, it consecutively executes the processing shown in FIG. 10 upon receiving the position sensor data.

The procedure shown in FIG. 11 will now be discussed below.

In step S301, the data separator 132*d* obtains environment sensor data from the sensor data obtaining unit 11. Then, in step S302, the data separator 132*d* copies the environment sensor data. Then, in step S303, the data separator 132*d* outputs one copy of the environment sensor data to the sender 14 and the other to the data converter 132*e*.

Then, in step S304, the data converter 132*e* performs destination-based data processing on the environment sensor data. If the first management server 70 is a destination of the environment sensor data, the data converter 132*e* performs data processing based on the first management server 70 on the environment sensor data. If the second management server 80 is a destination of the environment sensor data, the data converter 132*e* performs data processing based on the second management server 80 on the environment sensor data.

Then, in step S305, the data converter 132*e* outputs the environment sensor data subjected to the data processing based on the first management server 70 to the protocol converter 132*f*. In step S306, the data converter 132*e* also outputs the environment sensor data subjected to the data processing based on the second management server 80 to the sender 14. When executing steps S305 and S306, either one of steps S305 and S306 may be executed first, or steps S305 and S306 may be executed in parallel.

In step S307, the protocol converter 132*f* converts the data format of the environment sensor data from REST to fluentd. Then, in step S308, the protocol converter 132*f* outputs the converted environment sensor data to the sender 14. As a result, the processing has been completed.

Upon receiving the environment sensor data, the sender 14 sends the environment sensor data to a destination according to the data format of the environment sensor data. That is, the sender 14 sends the environment sensor data in the data format fluentd to the first management server 70 and sends the environment sensor data in the data format REST to the second management server 80.

If, as stated above, the sensor data processor 132 performs stream-data processing, it consecutively executes the processing shown in FIG. 11 upon receiving the environment sensor data, as in the case of the processing shown in FIG. 10.

(Display Examples of Screens of Image Processing Apparatus)

A description will now be given below, with reference to FIGS. 12A through 12D, of screens displayed on the operation panel 105 of the image processing apparatus 10 based on position sensor data and environment sensor data.

Figures 12A, 12B, 12C, 12D:
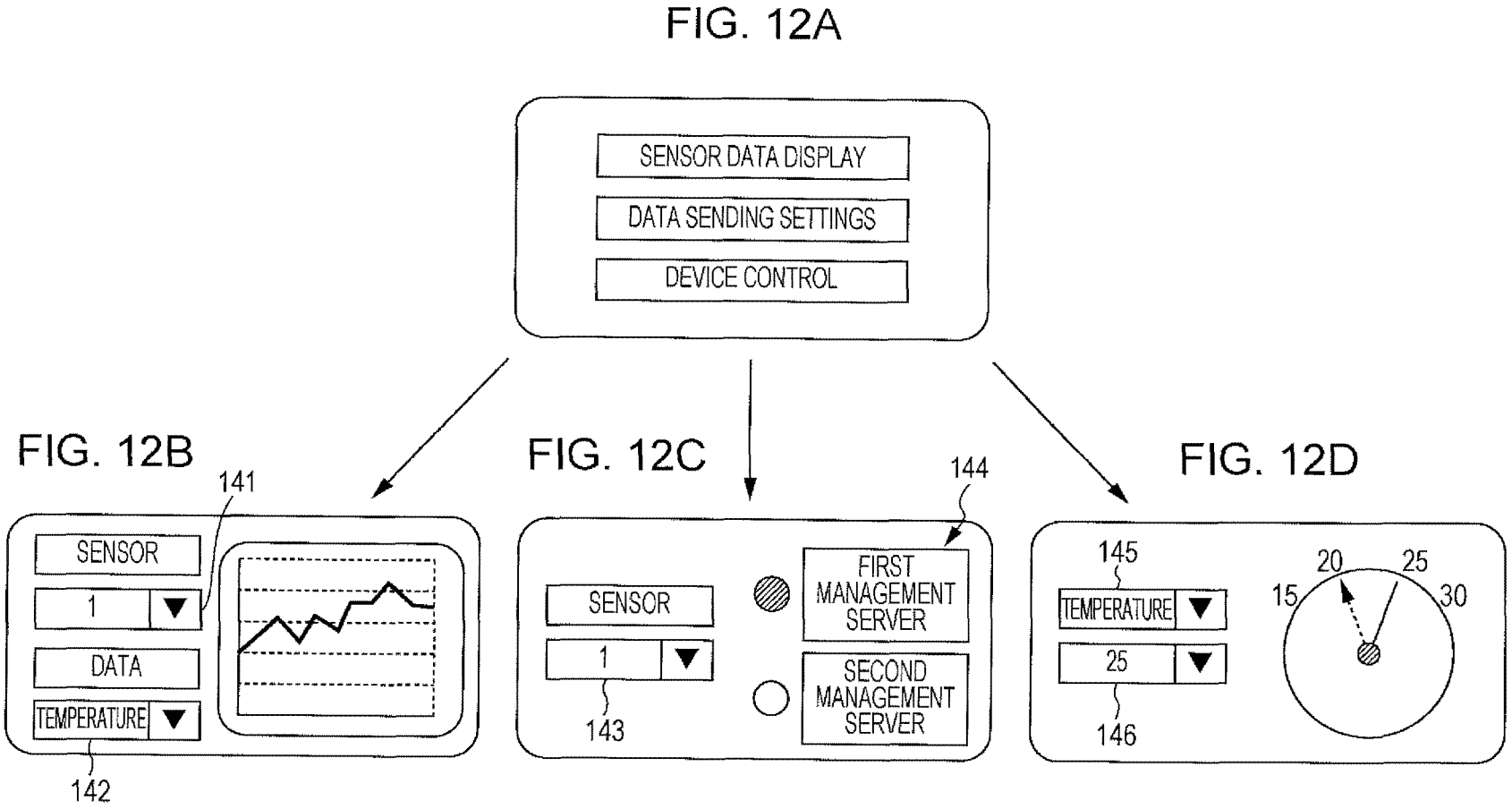
FIGS. 12A through 12D illustrate examples of screens displayed based on position sensor data and environment sensor data.

The screen shown in FIG. 12A is a home screen. On this home screen, multiple selection buttons are displayed. When one of the selection buttons is selected by a user, the screen associated with the selected button is displayed. In the example shown in FIG. 12A, three selection buttons, that is, "sensor data display", "data sending settings", and "device control" buttons are provided. When the "sensor data display" button is selected, the screen shown in FIG. 12B, for example, is displayed. When the "data sending settings" button is selected, the screen shown in FIG. 12C, for example, is displayed. When the "device control" button is selected, the screen shown in FIG. 12D, for example, is displayed.

The screen shown in FIG. 12B is a screen for controlling the display of sensor data. On this screen, a sensor selecting button 141 for selecting a sensor and a display item selecting button 142 for selecting a display item are shown. When a user points to the inverted solid triangle at the right side of the sensor selecting button 141, the ID numbers assigned to the environment sensor 30 and the position sensor 40 are displayed on a drop-down menu. The user may simply select the ID of a desired sensor from the drop-down menu. When a user points to the inverted solid triangle at the right side of the display item selecting button 142, items of information included in the sensor data are displayed on a drop-down menu. The user may simply select a desired item to be displayed from the drop-down menu.

In the example shown in FIG. 12B, the environment sensor 30 having the ID number ID=1 is selected as the sensor and the temperature is selected as the display item. Information concerning the temperature supplied from the environment sensor 30 (ID=1) is displayed in chronological order.

The screen shown in FIG. 12C is a screen for controlling the sending of sensor data. On this screen, a sensor selecting button 143 for selecting a sensor and a destination selecting button 144 for selecting a destination are displayed. When a user points to the inverted solid triangle at the right side of the sensor selecting button 143, the ID numbers assigned to the environment sensor 30 and the position sensor 40 are displayed on a drop-down menu. The user may simply select the ID of a desired sensor from the drop-down menu. The sensor selecting button 143 may be considered as an input section that receives an instruction to specify a sensor from among plural sensors by a user. Concerning the destination selecting button 144, the user may simply select from the drop-down menu the device name of a destination to which sensor data of the sensor ID selected by using the sensor selecting button 143 will be sent. The destination selecting button 144 may be considered as an input section that receives an instruction to specify a destination of sensor data which is received from the sensor selected by the user with the sensor selecting button 143.

In the example shown in FIG. 12C, the first management server 70 is selected as a destination of environment sensor data supplied from the environment sensor 30 (ID=1). Accordingly, the image processing apparatus 10 performs processing on the environment sensor data supplied from the environment sensor 30 (ID=1) so that the environment sensor data can be sent to the first management server 70. If, for example, the user also selects the second management server 80 as a destination, the image processing apparatus 10 performs processing on the environment sensor data so that the environment sensor data can be sent to both of the first and second management servers 70 and 80.

The screen shown in FIG. 12D is a screen for controlling the air conditioner 60. On this screen, a control target item button 145 for selecting an item to be controlled and a target value selecting button 146 for selecting a target value are displayed. On this screen, instead of the user selecting a control target item and a target value, as indicated by the processing shown in FIGS. 5A and 5B, the control content indicated by air-conditioning control information generated by the air-conditioning control information generator 131 based on the position sensor data and the environment sensor data may be displayed. Alternatively, the user may select a control target item and a target value, and the air-conditioning control information generator 131 may generate air-conditioning control information according to the control target item and the target value selected by the user.

If the user selects a control target item on the screen, the user points to the inverted solid triangle at the right side of the control target item button 145. Then, items that can be controlled in the air conditioner 60 are displayed on a drop-down menu. The user may simply select a desired item to be controlled from the drop-down menu. Concerning the target value selecting button 146, when the user points to the inverted solid triangle at the right side of the target value selecting button 146, values of the selected target item are displayed on a drop-down menu. The user may simply select a target value from the drop-down menu.

In the example shown in FIG. 12D, the temperature is selected as the item to be controlled in the air conditioner 60. The current temperature is 20° C. and the target value of the temperature is 25° C. In this example, the control content represented by the air-conditioning control information generated by the air-conditioning control information generator 131 based on the position sensor data and the environment sensor data indicates that the set temperature will be increased to 25° C. Alternatively, as a result of the user selecting a control target item and a target value on the screen, the air-conditioning control information generator 131 may generate air-conditioning control information indicating that the set temperature will be increased to 25° C.

(Modified Examples of Position Sensor and Transmitter)

Figure 13A:
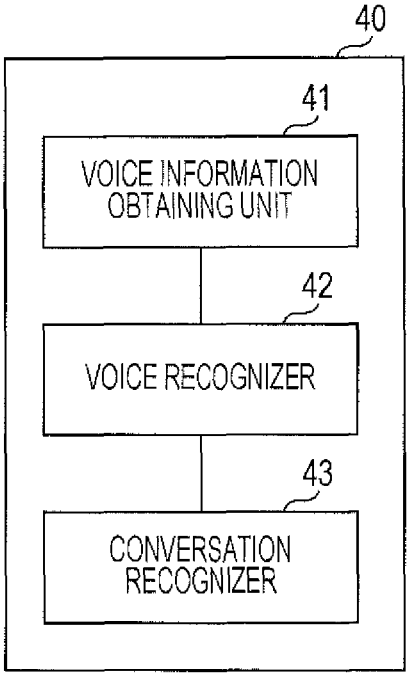
FIGS. 13A and 13B are block diagrams illustrating modified examples of a position sensor and a transmitter, respectively.
Figure 13B:
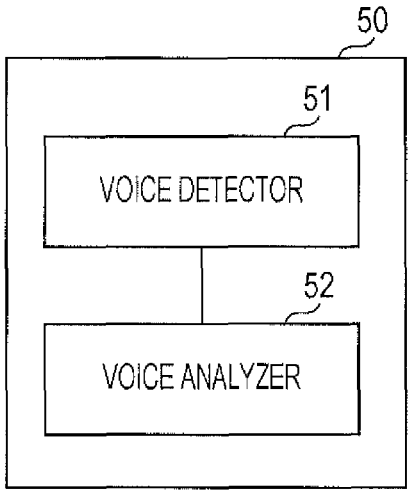

Modified examples of the position sensor 40 and the transmitter 50 will be described below with reference to the block diagrams of FIGS. 13A and 13B, respectively. As shown in FIG. 13A, the position sensor 40 includes a voice information obtaining unit 41, a voice recognizer 42, and a conversation recognizer 43. As shown in FIG. 13B, the transmitter 50 includes a voice detector 51 and a voice analyzer 52.

The voice detector 51 of the transmitter 50 is a device for detecting voice around the transmitter 50, such as a microphone. The voice detector 51 detects the voice of a user carrying the transmitter 50 and sends voice information concerning the detected user voice to the position sensor 40.

The voice information obtaining unit 41 of the position sensor 40 receives voice information supplied from the transmitter 50. The voice recognizer 42 determines whether or not the user carrying the transmitter 50 is speaking, based on the voice information received from the transmitter 50. In this case, the voice recognizer 42 sets a reference value in advance, and if the volume of the voice indicated by the voice information exceeds the reference value, the voice recognizer 42 determines that the user is speaking.

The transmitter 50 may include, not a single microphone, but at least a pair of microphones (first and second microphones) as the voice detector 51. In this case, the voice analyzer 52 determines whether the voice collected by the first and second microphones is voice output from the user carrying the transmitter 50 or from another user.

This will be explained more specifically. The first microphone is installed at a far position separated from the mouth of the user carrying the transmitter 50 by about 35 cm, while the second microphone is installed at a near position separated from the mouth of this user by about 10 cm. The voice analyzer 52 identifies the speaker from the voice collected by the first and second microphones. In this case, the voice analyzer 52 identifies the speaker, not based on linguistic information obtained by using morphological analysis or dictionaries, but based on non-linguistic information such as the sound pressure (the volume of voice input into the first and second microphones).

The sound pressure of voice collected by each of the first and second microphones becomes weaker as the distance between each of the first and second microphones and a sound source is increased. Accordingly, regarding the voice output from the user carrying the transmitter 50, there is a great difference between the sound pressure of voice collected by the first microphone and that by the second microphone. In contrast, if the sound source is the mouth of another user, since this user is located at a position separated from the user carrying the transmitter 50, the distance between the first microphone and the sound source is not so much different from that between the second microphone and the sound source. Accordingly, regarding the voice output from another user, there is no great difference between the sound pressure of voice collected by the first microphone and that by the second microphone, unlike the voice output from the user carrying the transmitter 50. In this manner, by utilizing the difference in the sound pressure, the voice analyzer 52 distinguishes the voice output from the user carrying the transmitter 50 collected by the first and second microphones from that output from another user.

A situation where two users, a user A carrying a transmitter 50A and a user B carrying a transmitter 50B, are having a conversation will now be considered. In this case, the voice which is recognized as the voice of the user A by the transmitter 50A is recognized as the voice of another user by the transmitter 50B, and vice versa. Voice information is sent separately from the transmitter 50A and the transmitter 50B to the position sensor 40. As stated above, the recognition result concerning which of the user A or the user B is speaking obtained from the transmitter 50A is opposite to that from the transmitter 50B. However, information indicating the situations of the conversation, such as the length of the time of the conversation and the timing at which the speaker is switched from one user to another, obtained from the transmitter 50A is similar to that from the transmitter 50B.

From this point of view, the conversation recognizer 43 of the position sensor 40 determines whether or not the user A and the user B are engaging in the same conversation, based on the voice information supplied from the transmitters 50A and 50B. In other words, the conversation recognizer 43 compares the voice information obtained from the transmitter 50A with that from the transmitter 50B, and if the situations of the conversation indicated by the voice information obtained from the transmitter 50A are similar to those from the transmitter 50B, the conversation recognizer 43 determines that the user A and the user B are engaging in the same conversation. As information indicating the situations of the conversation, time information concerning the conversation, such as the length of the time for which each user speaks, the start and end times at which each user speaks, and the timing at which the speaker is switched from one user to another, is used.

A determination as to whether or not plural users (plural transmitters 50) are engaging in the same conversation may be made in another manner. If, for example, it is determined, based on position information and voice information supplied from each of the transmitters 50, that the users associated with the transmitters 50 are located within a predetermined region and are speaking at almost the same time, the conversation recognizer 43 may determine that the users are engaging in the same conversation.

Voice information supplied from the transmitters 50, information indicating that the user associated with a certain transmitter 50 is speaking obtained by the voice recognizer 42, and information that plural users are engaging in the same conversation obtained by the conversation recognizer 43 are included in the position sensor data and are sent from the position sensor 40 to the image processing apparatus 10.

If the conversation recognizer 43 determines that plural users are engaging in the same conversation, the position sensor 40 may store all the IDs of the transmitters 50 of these users in the position sensor data and may send the position sensor data to the image processing apparatus 10. In this case, instead of sending voice information obtained from each of the plural transmitters 50, the position sensor 40 may send voice information obtained from one of the plural transmitters 50 to the image processing apparatus 10. With this configuration, the position sensor 40 can send the summarized information concerning the plural transmitters 50 to the image processing apparatus 10 as position sensor data. As a result, the traffic can be reduced, compared with a case in which the position sensor 40 sends position sensor data concerning each of the plural transmitters 50 to the image processing apparatus 10.

If the conversation recognizer 43 determines that plural users are engaging in the same conversation, it may detect whether or not the conversation is going well, based on, for example, the ratio of the period of the time for which nobody is speaking to the total length of the conversation time. For example, as the total time at which nobody is speaking is shorter, the possibility that somebody is speaking is higher, and then, the conversation recognizer 43 assumes that the active index (level) of the conversation is higher. In this case, if the conversation recognizer 43 detects that the conversation is going well, the air-conditioning control information generator 131 may correct air-conditioning control information. If the active index of the conversation is equal to or higher than a predetermined value, it means that the conversation is going well, and thus, the air-conditioning control information generator 131 may correct air-conditioning control information so that the temperature of the air conditioner 60 will be reduced.

In the above-described exemplary embodiment, the image processing apparatus 10 generates air-conditioning control information for controlling the air conditioner 60, based on environment sensor data and position sensor data. However, the target to be controlled by the image processing apparatus 10 is not restricted to the air conditioner 60.

For example, the air-conditioning control information generator 131 may generate control information for controlling lighting fixed within the area, based on environment sensor data and position sensor data. For example, if the lighting is ON even though nobody is within the area, the air-conditioning control information generator 131 may generate control information for controlling the lighting so that the lighting will be turned OFF. If the conversation recognizer 43 detects that the conversion is not going well, the air-conditioning control information generator 131 may generate control information for controlling the lighting so that the illuminance will be increased, and may also generate air-conditioning control information for controlling the air conditioner 60 so that the temperature will be decreased in accordance with an increase in the illuminance.

The air-conditioning control information generator 131 may also generate control information for controlling the terminal device 20 installed within the area, based on environment sensor data and position sensor data. For example, if the terminal device 20 is ON even though nobody is within the area, the air-conditioning control information generator 131 may generate control information for controlling the terminal device 20 so that the terminal device 20 will enter the standby state.

In the above-described exemplary embodiment, when the sensor data processor 132 performs destination-based processing on sensor data, it first performs destination-based data processing and then performs protocol conversion processing based on the destination. However, the sensor data processor 132 may first perform protocol conversion processing based on the destination and then perform destination-based data processing.

In the above-described exemplary embodiment, processing performed by the sensor data obtaining unit 11, the outside-area information receiver 12, the processor 13, the sender 14, and the inside-area information receiver 15 of the image processing apparatus 10 may be performed by another device other than the image processing apparatus 10, such as a server device.

A program implementing the above-described exemplary embodiment may be provided via a communication medium, or may be stored in a recording medium, such as a compact disc-read only memory (CD-ROM), and be provided.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

a first obtaining unit that obtains, from each of a plurality of measuring devices provided in different locations outside an air-conditioning control device, environment information indicating an environment around a corresponding measuring device;

a second obtaining unit that obtains position information indicating a position of a user;

an output unit that outputs air-conditioning control information based on the obtained environment information and the obtained position information for controlling a subject air-conditioning control device; and a sender that sends the output air-conditioning control information to a destination device.

2. The image forming apparatus according to claim 1, further comprising:

a receiver that receives, from an external area outside of an area where the subject air-conditioning control device performs air-conditioning control, external information concerning air conditioning of the external area, wherein the output unit corrects the air-conditioning control information for controlling the subject air-conditioning control device, based on the received external information.

3. The image forming apparatus according to claim 2, wherein:

the receiver receives information indicating a power supply and demand situation as the external information; and the output unit corrects the air-conditioning control information for controlling the subject air-conditioning control device if power consumption represented by the information indicating the power supply and demand situation exceeds a predetermined value.

4. The image forming apparatus according to claim 2, wherein:

the receiver receives air-conditioning control information for controlling another air-conditioning control device as the external information; and the output unit corrects the air-conditioning control information for the subject air-conditioning control device, based on the air-conditioning control information for controlling another air-conditioning control device.

5. The image forming apparatus according to claim 1, further comprising:

a comparator that compares different items of environment information obtained by the first obtaining unit from the plurality of measuring devices, wherein the first obtaining unit obtains time-series environment information from each of the plurality of measuring devices, the comparator compares a degree of a variation in the time-series environment information output from a measuring device with a degree of a variation in the time-series environment information output from another measuring device among the plurality of measuring devices, and the output unit outputs air-conditioning control information for controlling an air-conditioning control device that controls air conditioning around a measuring device that has output the time-series environment information for which the highest degree of a variation is found by the comparator, so that the highest degree of the variation in the time-series environment information will be decreased.

6. The image forming apparatus according to claim 1, further comprising:

a power supply amount obtaining unit that obtains information concerning an amount of power supply measured in the subject air-conditioning control device from the subject air-conditioning control device, wherein the output unit corrects the air-conditioning control information for controlling the subject air-conditioning control device if the amount of power supply indicated by the information concerning the amount of power supply exceeds a predetermined value.

7. The image forming apparatus according to claim 1, wherein the output unit corrects the air-conditioning control information for controlling the subject air-conditioning control device if the number of operating information processing devices located within an area where the subject air-conditioning control device performs air conditioning is equal to or smaller than a predetermined value.

8. An information processing system comprising:

a plurality of transmitting devices that are each carried by a user and each transmit identification information for identifying a corresponding user;

a plurality of receiving devices that are provided in different locations and each receive the identification information from a transmitting device located within a detection range of a corresponding receiving device; and an image forming apparatus that forms an image on a recording medium, the image forming apparatus including a first obtaining unit that obtains, from each of a plurality of measuring devices provided in different locations outside an air-conditioning control device, environment information indicating an environment around a corresponding measuring device, a second obtaining unit that obtains position information indicating a position of a user, based on the identification information received by each of the plurality of receiving device, an output unit that outputs air-conditioning control information based on the obtained environment information and the obtained position information for controlling a subject air-conditioning control device, and a sender that sends the output air-conditioning control information to a destination device.

9. The information processing system according to claim 8, wherein:

each of the plurality of transmitting devices includes a voice detector that detects voice around a corresponding transmitting device and sends voice information concerning the detected voice; and each of the plurality of receiving devices includes a conversation recognizer that determines whether or not a plurality of users are engaging in the same conversation, based on the voice information received from each of a plurality of transmitting devices located within a detection range of a corresponding receiving device, and if the conversation recognizer determines that a plurality of users are engaging in the same conversation, the conversation recognizer sends voice information obtained from one of the plurality of transmitting devices carried by the plurality of users engaging in the same conversation to the image forming apparatus, instead of sending voice information obtained from each of the plurality of transmitting devices.

10. The information processing system according to claim 9, wherein:

if the conversation recognizer determines that a plurality of users are engaging in the same conversation, the conversation recognizer determines whether or not the conversation is going well, based on the voice information obtained from each of the plurality of transmitting devices carried by the plurality of users engaging in the same conversation; and if the conversation recognizer determines that the conversation is going well, the output unit corrects the air-conditioning control information for controlling the subject air-conditioning control device.

11. An image forming method comprising:

forming an image on a recording medium;

obtaining, from each of a plurality of measuring devices provided in different locations outside an air-conditioning control device, environment information indicating an environment around a corresponding measuring device;

obtaining position information indicating a position of a user;

outputting air-conditioning control information based on the obtained environment information and the obtained position information for controlling a subject air-conditioning control device; and sending the output air-conditioning control information to a destination device.

* * * * *